US011828450B1

(12) United States Patent
Wang

(10) Patent No.: US 11,828,450 B1
(45) Date of Patent: Nov. 28, 2023

(54) FENCE LIGHT

(71) Applicant: Linhai Shengying Trading Co., LTD., Taizhou (CN)

(72) Inventor: Qiaoyan Wang, Taizhou (CN)

(73) Assignee: Linhai Shengying Trading Co., LTD., Taizhou (CN)

( * ) Notice: Subject to any disclaimer, the term of this patent is extended or adjusted under 35 U.S.C. 154(b) by 0 days.

(21) Appl. No.: 18/155,558

(22) Filed: Jan. 17, 2023

(51) Int. Cl.
*F21V 33/00* (2006.01)
*E04H 17/14* (2006.01)
*F21V 23/00* (2015.01)

(52) U.S. Cl.
CPC ..... *F21V 33/006* (2013.01); *E04H 17/1426* (2013.01); *F21V 23/002* (2013.01)

(58) Field of Classification Search
CPC ..... E04H 17/017; E04H 17/1426
See application file for complete search history.

(56) References Cited

U.S. PATENT DOCUMENTS 1,985,322 A * 12/1934 La Clair ..... E04H 17/1426 256/22
10,876,727 B1 * 12/2020 Xi ..... F21S 4/28
2003/0075712 A1 * 4/2003 Lin ..... E04H 17/017 256/1
2008/0099751 A1 * 5/2008 Chen ..... F21V 33/006 256/19
2019/0368721 A1 * 12/2019 Xu ..... H05B 45/10

FOREIGN PATENT DOCUMENTS

CN 201521861 U 7/2010
CN 201568810 U 9/2010
CN 209991325 U 1/2020

* cited by examiner

*Primary Examiner* — Alexander K Garlen
(74) *Attorney, Agent, or Firm* — Nitin Kaushik

(57) ABSTRACT

The present invention discloses a decorative illuminating light, and aims to provide a fence light, including a fence board body. The fence board body includes a front housing, a rear housing, and a light string wire. The front housing includes a plurality of transverse boards and a plurality of vertical boards. The transverse boards and the vertical boards are in cross connection with each other. The rear housing is adapted to the front housing and is detachably connected to the front housing. A receiving chamber is formed inside after the front housing is spliced with the rear housing. The light string wire is placed in the receiving chamber. After the front housing is spliced with the rear housing, the transverse boards form transverse fixing columns of the fence board body, and the vertical boards form vertical fixing columns of the fence board body.

5 Claims, 5 Drawing Sheets

FENCE LIGHT

TECHNICAL FIELD

The present invention relates to the technical field of colored lights, and more specifically, to a fence light.

BACKGROUND

Fences are widely used in our production and life, including garden fences, highway fences, municipal fences, etc. A fence includes fence boards and transverse strip hoards, and is mainly mounted for decoration and simple protection. For beautification and illumination, people often mount some colored lights on the fence to form a colored light fence. An existing connection method for the colored light fence in the market is to first arrange a light wire in housings of the fence boards, then insert the transverse strip boards into the fence boards, and clamp and fix the fence boards and the transverse strip boards. In such mounting and connection method, when the transverse strip boards are inserted into the fence boards, all the fence boards need to be inserted in sequence. Such mounting method is difficult. Moreover, after the plurality of fence boards are connected, a larger resistance will be received during continuous insertion, making it difficult to continue insertion. Therefore, a fence light having a novel structure and being easy and convenient to mount is urgently needed.

SUMMARY

In view of the deficiencies existing in the prior art, an objective of the present invention is to provide a fence light.

To achieve the above objective, the present invention provides the following technical solution: a fence light, including a fence board body, where the fence board body includes a front housing, a rear housing, and a light string wire, the front housing includes a plurality of transverse boards and a plurality of vertical boards, the transverse boards and the vertical boards are in cross connection with each other, the rear housing is adapted to the front housing and is detachably connected to the front housing, a receiving chamber is formed inside after the front housing is spliced with the rear housing, and the light string wire is placed in the receiving chamber.

Further, after the front housing is spliced with the rear housing, the transverse boards form transverse fixing columns of the fence board body, and the vertical boards form vertical fixing columns of the fence board body; and mounting grooves for mounting various decorative bodies with different shapes are arranged at tops of the vertical fixing columns.

Further, wire damping grooves for placing the light string wire are arranged on an inner surface of the rear housing.

Further, the front housing and the rear housing are connected via a buckle combination portion, and the buckle combination portion includes clamping columns arranged in the front housing and clamping grooves arranged in the rear housing and adapted to the clamping columns.

Further, an inner diameter of the mounting grooves gradually increases along an insertion direction of the decorative bodies, drainage channels are further arranged on groove walls of the mounting grooves, and water outlets of the drainage channels are arranged on the rear housing.

Further, waterproof tapes are arranged at groove openings and groove bottoms of the mounting grooves.

With the adoption of the above technical solution, the front housing and the rear housing of the fence board body are detachably connected, each of the front housing and the rear housing includes a plurality of transverse rods and a plurality of vertical rods that are integrally connected, and the transverse rods and the vertical rods are mutually crossed and integrally formed. When being assembled, the front housing and the rear housing only need to be butted via the buckle combination portion to complete the overall connection of the fence board body. This connection process is simple and convenient, and does not include a step of in the transverse rods into the vertical rods. The transverse rods are arranged above and below the vertical rods, respectively, to connect the transverse rods in series and fix the transverse rods, so that the vertical rods are firmly connected.

The mounting grooves arranged at the tops of the vertical mounting columns formed by splicing the vertical rods may be inserted with the decorative bodies. The decorative bodies are clamped with the mounting grooves. The arranged mounting grooves may stably bear the decorative bodies. The drainage channels arranged on groove walls of the mounting grooves may ensure that the fence light drains rainwater at joints between the decorative bodies and the vertical mounting columns in time on rainy days, to ensure that an interior of the fence light will not be soaked with the rainwater.

Figure 1:
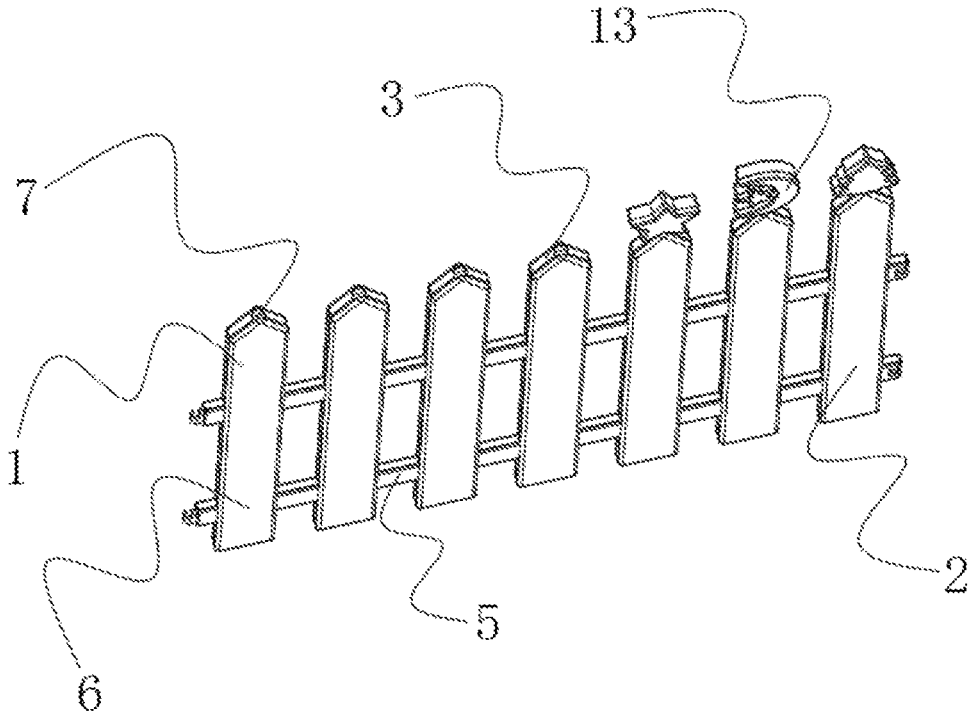
FIG. 1 is a schematic structural diagram of an embodiment of a fence light according to the present invention.
Figure 2:
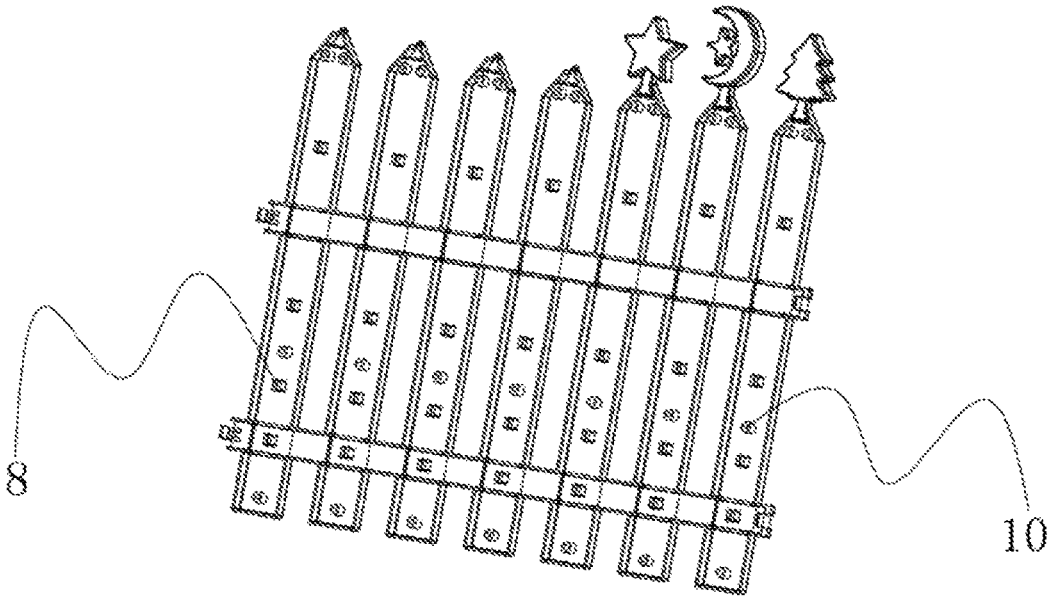
FIG. 2 is a schematic structural diagram of an interior of a rear housing.
Figure 3:
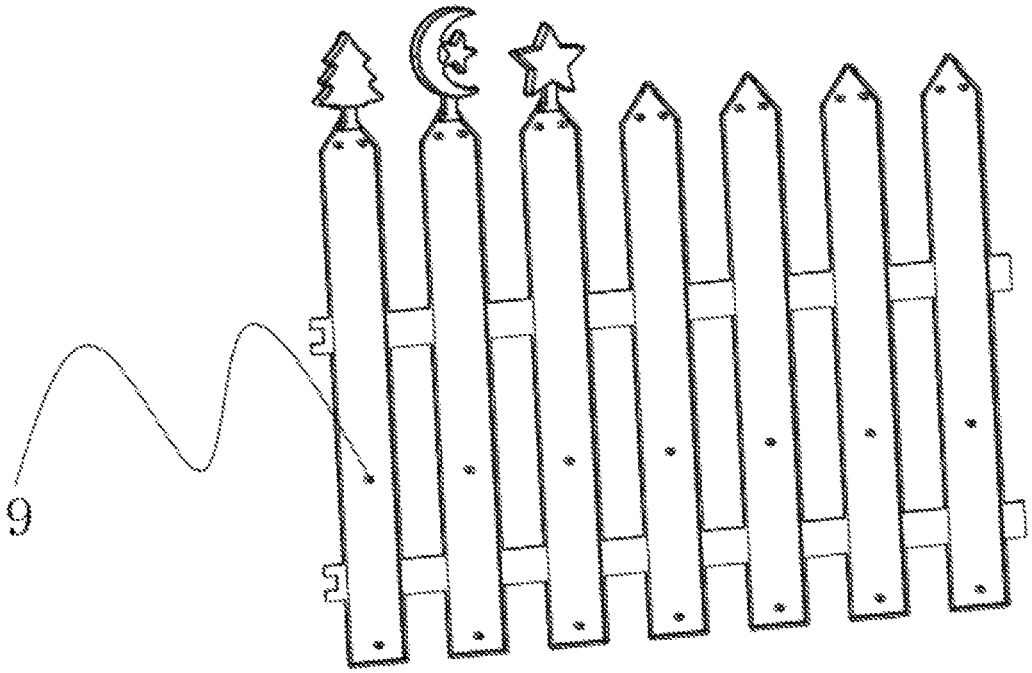
FIG. 3 is a schematic structural diagram of an interior of a front housing.
Figure 4:
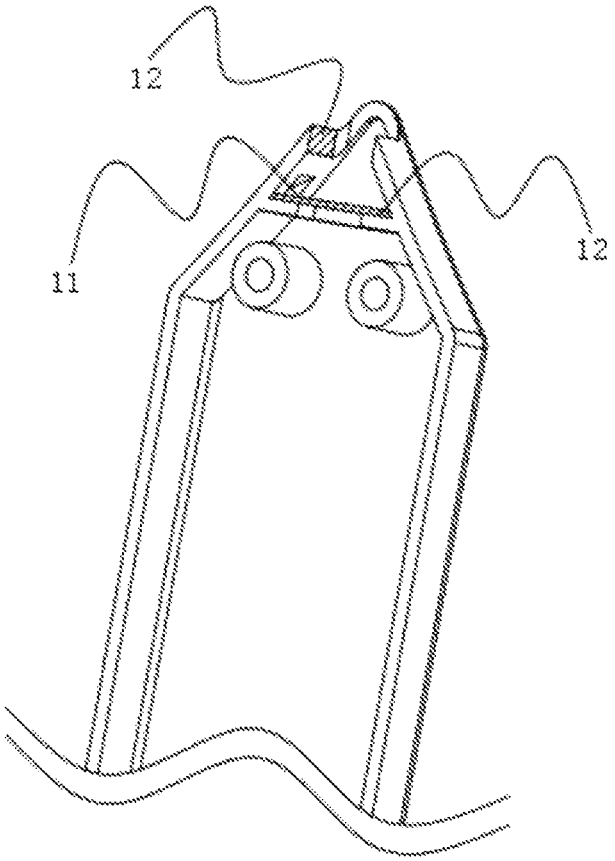
FIG. 4 is a schematic structural diagram of a top of a vertical fixing column.

Reference numbers in figures: 1. fence board body; 2. front housing; 3. rear housing; 4. light string wire; 5. transverse board; 6. vertical board; 7. mounting groove; 8. wire clamping column; 9. clamping column; 10. clamping groove; 11. drainage channel; 12. waterproof tape; and 13. decorative body.

DETAILED DESCRIPTION OF THE EMBODIMENTS

The embodiment of a fence light according to the present invention is further described with reference to FIG. 1 to FIG. 5.

For ease of explanation, the relative spatial terms such as "up", "down", "left", and "right" are used in the embodiment to explain the relationship between one element or feature and another element or feature shown in the figure. It should be understood that in addition to the orientations shown in the figure, the spatial terms are intended to include different orientations of an apparatus in use or operation. For example, if the apparatus in the figure is inverted, the element described as being located "below" other element or feature will be positioned "above" other element or feature. Therefore, the exemplary term "below" may include both an upper and a lower orientation. The apparatus, may be positioned in other manner (rotated 90° or positioned in other orientation), and the relative spatial description used here may be explained accordingly.

Moreover, the relational terms such as "first" and "second" are only used for distinguishing one component with the same name from another one, and do not necessarily require or imply any such actual relationship or order between these components.

Embodiment 1

A fence light includes a fence board body 1. The fence board body 1 includes a front housing 2, a rear housing 3, and a light string wire 4. The front housing 2 includes a plurality of transverse boards 5 and a plurality of vertical boards 6. The transverse boards 5 are in cross connection with the vertical boards. The rear housing 3 is adapted to the front housing 2 and is detachably connected to the front housing 2. A receiving chamber is formed inside after the front housing 2 is spliced with the rear housing 3. The light string wire 4 is placed in the receiving chamber. The front housing 2 is connected to the rear housing 3 via a buckle combination portion. The buckle combination portion includes clamping columns 9 arranged in the front housing 2 and clamping grooves 10 arranged in the rear housing 3 and adapted to the clamping columns 9. The plurality of clamping columns 9 and the plurality of clamping grooves 10 are arranged in the housings, which may ensure close connection between ends and middles of the housings. Wire clamping grooves 8 for placing the light string wire 4 are arranged on the inner surface of the rear housing 3. The light string wire 4 first enters the housing from a port of one of the transverse boards 5; when entering the vertical board 6 on the rear housing 3, the light string wire 4 is routed upwards via a joint between the vertical hoard 6 and the transverse board 5, is wound to enter the wire clamping groove 8, then is routed to a top of the vertical board 6, bypasses the clamping column 9 to return to a bottom of the vertical board 6 along the other side of the vertical board 6, then enters the horizontal board 5 again, and is ready to continue to enter the next vertical board 6; and after being routed in the plurality of vertical boards 6 in sequence, finally the light string wire 4 is led out from the other port of the transverse hoard 5, which may ensure that the light string wire 4 illuminates all the vertical boards 6 to achieve the, better decoration and lighting effects.

After the front housing 2 is spliced with the rear housing 3, the transverse boards 5 form transverse fixing columns of the fence board body 1, and the vertical boards 6 form vertical fixing columns of the fence board body 1. A splicing mounting method for the fence board body 1 is to directly splice the front housing 2 and the rear housing 3 to complete the connection and fixation. Compared to a connection method for insertion between the remaining transverse boards 5 and vertical boards 6, this structure may he mounted more quickly and stably. Mounting grooves 7 for mounting various decorative bodies 13 with different shapes are arranged at tops of the vertical fixing columns. An inner diameter of the mounting grooves 7 gradually increases along an insertion direction of the decorative bodies 13. Drainage channels 11 are further arranged on groove walls of the mounting grooves 7. Water outlets of the drainage channels are arranged on the rear housing 3. The decorative bodies 13 may be set to he Christmas trees, moons, stars, and other decorations. Bottoms of the decorative bodies 13 are adapted in shape to the mounting grooves 7 and are clamped with the mounting grooves 7. The mounting grooves 7 are set to be triangular, which may ensure that the decorative bodies 13 will not fall off Waterproof tapes 12 are arranged at groove openings and groove bottoms of the mounting grooves 7. The waterproof tapes 12 reduce gaps between the decorative bodies 13 and the mounting grooves 7, which may ensure that water vapor and rainwater will not enter the fence board body 1. Each drainage channel 11 has one end connected to the groove wall of the corresponding mounting groove 7 and the other end connected to the outside via the rear housing 3, so that the water entering the mounting grooves 7 may he timely drained to protect the light string wire 4 inside the housings.

Embodiment 2

The arrangement of this embodiment is substantially the same as that of the embodiment 1, but the only difference is that the front housing 2 and the rear housing 3 are fixedly connected via screws and screw holes. The screw holes are arranged on the front housing 2 and the rear housing 3. The screws enter the rear housing 3 from the front housing 2 to he in threaded connection with the rear housing 3. The screws and the screw holes are arranged around the front housing 2 and the rear housing 3. This connection method is stable and firm. The gap between the front housing 2 and the rear housing 3 is smaller, so that the higher sealing performance is achieved.

Embodiment 3

The arrangement of this embodiment is substantially the same as that of the embodiment 1, but the only difference is that the front housing 2 and the rear housing 3 are fixedly connected via the buckle combination portion. The buckle combination portion includes buckles arranged on the front housing 2 and clamping blocks arranged on the rear housing 3 and adapted to the buckles. When being connected, the front housing 2 and the rear housing 3 may he directly butted to complete the fixation. The clamping blocks and the buckles are arranged around the front housing 2 and the rear housing 3. This connection method is fast in mounting, simple in disassembly, and highly practical.

Embodiment 4

Figure 5:
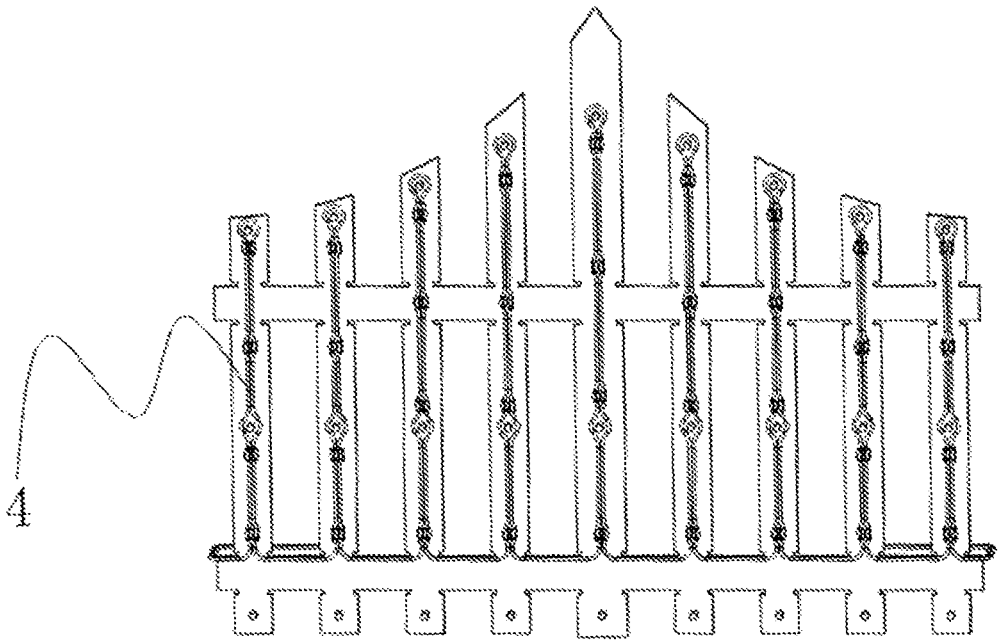
FIG. 5 is a schematic diagram of routing of a light string wire.

The arrangement of this embodiment is substantially the same as that of the embodiment 1, but the only difference is that, as shown in FIG. 5, the vertical boards 6 are set to be different in length and present an undulating shape, which forms a fence shape with low two ends and high middle. This shape is closer to the shape of an outdoor fence, so that the better decorativeness is achieved.

The above are only the preferred embodiments of the present invention, and are not intended to limit the present invention. Common changes and substitutions made by those skilled in the art within the scope of the technical solution of the present invention should be all included in the scope of protection of the present invention.

What is claimed is:

1. A fence light, comprising a fence board body, wherein the fence board body comprises a front housing, a rear housing, and a light string wire, the front housing comprises a plurality of transverse boards and a plurality of vertical boards, the transverse boards and the vertical boards are in cross connection with each other, the rear housing is adapted to the front housing and is detachably connected to the front housing, a receiving chamber is formed inside after the front housing is spliced with the rear housing, and the light string wire is placed in the receiving chamber, wherein after the front housing is spliced with the rear housing, the transverse boards form transverse fixing columns of the fence board body, and the vertical boards form vertical fixing columns of the fence board body; and mounting grooves for mounting various decorative bodies with different shapes are arranged at tops of the vertical fixing columns.

2. The knee light according to claim 1, wherein wire clamping grooves for placing the light string wire are arranged on an inner surface of the rear housing.

3. The fence light according to claim 1, wherein the front housing and the rear housing are connected via a buckle combination portion, and the buckle combination portion comprises clamping columns arranged in the front housing and clamping grooves arranged in the rear housing and adapted to the clamping columns.

4. The fence light according to claim 1, wherein an inner diameter of the mounting grooves gradually increases along an insertion direction of the decorative bodies, drainage channels are further arranged on groove walls of the mounting grooves, and water outlets of the drainage channels are arranged on the rear housing.

5. The fence light according to claim 4, wherein waterproof tapes are arranged at groove openings and groove bottoms of the mounting grooves.

* * * * *